United States Patent [19]

Walter

[11] 4,150,864

[45] Apr. 24, 1979

[54] DOUBLE CONTACT BUS STRIP

[75] Inventor: Leo Walter, Palos Verdes Peninsula, Calif.

[73] Assignee: Electronic Stamping Corporation, Compton, Calif.

[21] Appl. No.: 875,160

[22] Filed: Feb. 6, 1978

[51] Int. Cl.[2] ..... H01R 31/08

[52] U.S. Cl. ..... 339/19; 339/95 D; 339/22 B

[58] Field of Search ..... 339/19, 22 B, 95 D, 339/258 R, 258 P

[56] References Cited

U.S. PATENT DOCUMENTS

| | | | |
|---|---|---|---|
| 3,315,219 | 4/1967 | Brinser et al. | 339/258 P |
| 3,474,389 | 10/1969 | Nagano | 339/95 D |
| 3,582,864 | 6/1971 | Sullivan | 339/22 B |
| 3,609,634 | 9/1971 | Hovnanian | 339/19 |
| 3,829,818 | 8/1974 | Iosue et al. | 339/19 |
| 4,033,657 | 7/1977 | Kemper | 339/19 |

FOREIGN PATENT DOCUMENTS

| | | | |
|---|---|---|---|
| 257048 | 8/1926 | United Kingdom | 339/258 R |

*Primary Examiner*—Gerald A. Dost
*Attorney, Agent, or Firm*—William W. Haefliger

[57] ABSTRACT

A double contact electrical bus strip to receive a terminal pin or post comprises:

(a) a horizontally elongated bus strip, and (b) two contacts in the form of hook-shaped tangs which are vertically spaced apart and which are integral with the bus strip, (c) each of the tangs extending generally vertically and diagonally relatively toward the bus strip, at one side thereof, (d) the tangs defining vertically spaced openings to pass the terminal post in vertically assembled relation between both tangs and the bus strip.

4 Claims, 4 Drawing Figures

DOUBLE CONTACT BUS STRIP

BACKGROUND OF THE INVENTION

This invention relates generally to bus connections to terminals such as wire wrap terminal pins, and more particularly concerns the provision of a double contact bus strip operable to connect a wire wrap pin or pins to a bus strip in unusually advantageous manner.

Prior bus connections to wire wrap terminals suffered many inherent disadvantages. These included lack of desired flexibility of selective connection of the post to the bus; bulkiness of the connection; need to connect contacts to the bus; need for new tooling for making different connection progressions along the strip; and lack of ease of assembly, disassembly and reassembly. These disadvantages are further aggravated by bus strips which are insulation covered. To my knowledge, no way was known to overcome these and other disadvantages, prior to the present invention.

SUMMARY OF THE INVENTION

It is a major object of the invention to provide a compact, double contact bus strip overcoming the above problems and also providing many additional advantages as will appear. Basically, the unit is operable to connect an electrical terminal pin or pins to a bus strip, and comprises:

(a) a horizontally elongated bus strip, and (b) two contacts in the form of hook-shaped tangs which are vertically spaced apart and which are integral with the bus strip, (c) each of said tangs extending generally vertically and diagonally relatively toward the bus strip, at one side thereof, (d) said tangs defining vertically spaced openings to pass the terminal post in vertically assembled relation between both tangs and the bus strip.

As will appear, the tangs have contact surfaces which extend sufficiently close to the bus strip as to be deflectible by the pin or post away from the bus strip and to resiliently urge the post toward and against the bus strip. Multiple pairs of such tangs are typically spaced along the strip and are integral with same; the two tangs of each pair typically project toward one another at one side of the strip; the openings in the tangs typically bifurcate them between the strip and the convex surfaces or contact surface; and the tangs are alike in configuration, all for purposes and advantages as will appear. Accordingly, a very simple and effective one piece multiple contact unit is provided to assure duo-contact with selectively inserted pins or posts.

These and other objects and advantages of the invention, as well as the details of an illustrative embodiment, will be more fully understood from the following description and drawings, in which:

DRAWING DESCRIPTION

DETAILED DESCRIPTION

Figure 1:
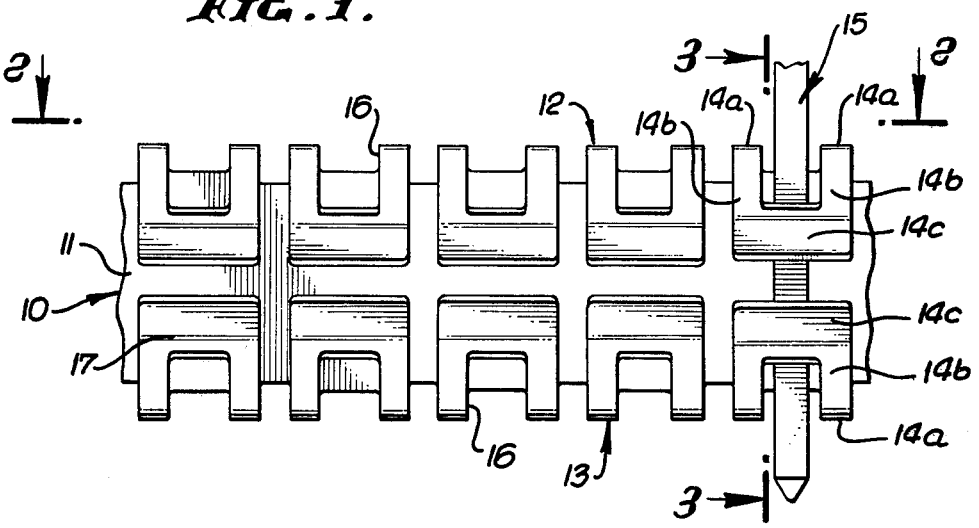
FIG. 1 is a frontal elevation.
Figure 2:
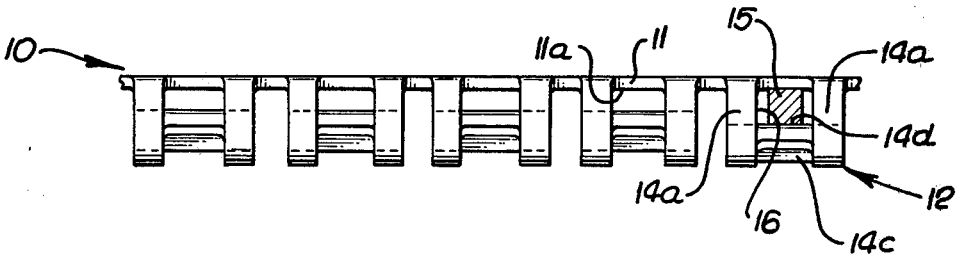
FIG. 2 is a top plan view taken on lines 2—2 of FIG. 1.

In the drawings, the combined double contact and bus strip 10 as illustrated includes a horizontally elongated bus strip 11 which is typically narrow in cross sectional thickness indicated at "t". For example, "t" may vary between about 0.010 and 0.006, and is typically about 0.008", for example. Two contacts in the form of hook-shaped tangs 12 and 13 are integral with the bus strip, and they are vertically spaced apart as is clear from FIGS. 3 and 4. The tangs and strip may for example consist of Beryllium copper, and may be heat treated for strength. Multiple pairs of tangs may be provided along the horizontally elongated strip 10, as seen in FIGS. 1 and 2. The overall height "h" of the device, i.e. between upper and lower edges of the tangs, may be about 0.180", by way of example.

Each of the tangs includes a generally hook-shaped section 14 integral with the upper or lower edge of bus strip. Section 14 extends laterally at 14*a*, then generally vertically and diagonally at 14*b* toward the bus strip at one side thereof, and then vertically and laterally at 14*c* away from the strip. Both tangs are at the same side of the strip to provide double contact, at noses 14*d*, with a post 15 received vertically adjacent the strip, as seen in FIG. 3.

The tangs also define vertically spaced openings 16 to pass the terminal pin or post 15 in vertically assembled relation between the two tangs and the inner side 11*a* of the but strip, whereby extensive and positive electrical contact between post and bus-contact unit 10 is assured, as well as positive retention of the post to the unit 10. In this regard, the opening 16 extends generally throughout lateral extent 14*a* and then vertically and laterally in section 14*b* toward and into proximity to nose 14*d*. Therefore, sections 14*a* and 14*b* are substantially bifurcated, facilitating ease of penetration of the post through the two tangs (i.e. assembly) and also assuring positive electrical contact as well as resilient deflection of the tangs upon assembly.

Figure 3:
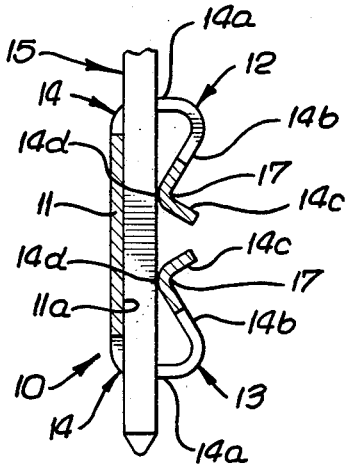
FIG. 3 is a side elevation taken in section on lines 3—3 of FIG. 1.
Figure 4:
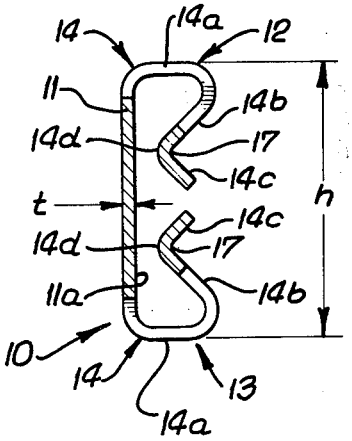
FIG. 4 is a view like FIG. 3 prior to insertion of a post into the clip.

The outer side of each tang, opposite the nose, is concave at region 17 indicated in FIGS. 1 and 3, for tang strength, the nose 14*d* being convex toward the bus strip. The rounded or concave bearing nose or contact surface 14*d* is yieldably deflectible by the post away from the bus strip so as to resiliently urge the post toward and against the bus strip, the two noses 14*d* acting in conjunction at spaced points along the post to maintain it flatly engaged with the inner side 11*a* of the bus strip. In this regard, the post may have a square or rectangular cross section, as shown, to assure positive contact with both contacts and with the bus strip. Note that the two tangs preferably extend toward one another, with end sections 14*c* closely spaced apart, for balance and to assure that the contact noses 14*d* extend toward portion of the bus-strip intermediate its upper and lower edges providing optimum protected electrical contact.

FIGS. 1 and 2 show multiple pairs of tangs as described, the pairs of tangs spaced apart horizontally along one side only of the bus strip. Note again the tangs and strip are of one-piece, integral, metallic construction, the thicknesses of the tangs being equal to the thickness "t" of the strip.

I claim:

1. In a double contact electrical bus strip to receive a terminal post, the combination comprising (a) a horizontally elongated bus strip, and (b) two contacts in the form of hook-shaped tangs which are vertically spaced apart and which are integral with the bus strip, (c) each of said tangs including a section having a first laterally extending portion, and a nose, the section including a second portion extending generally vertically and diagonally from said first portion relatively toward the nose and toward the bus strip, at one side thereof, the section having a third portion extending generally vertically and laterally away from the nose and the bus strip, (d) said first portions defining vertically spaced openings to pass the terminal post in vertically assembled relation between both tangs and the bus strip, (e) said first and second portions being continuously bifurcated between said bus strip and said nose, (f) said noses located vertically intermediate said tang first portions, and said noses having convex surfaces facing said bus strip, (g) the bus strip having a side facing said noses, said side extending vertically straight between said bifurcations.

2. The combination of claim 1 wherein the tangs extend toward one another and said noses extend sufficiently close to the bus strip to be yieldably deflectible by the post away from the bus strip and to resiliently urge the post toward and against the bus strip.

3. The combination of claim 1 including multiple pairs of tangs as defined, the pairs of tangs spaced horizontally apart along the bus strip.

4. The combination of claim 2 wherein said tangs are alike in configuration, and are confined at one side only of the bus strip.

* * * * *

UNITED STATES PATENT AND TRADEMARK OFFICE

Certificate

Patent No. 4,150,864

Patented April 24, 1979

Leo Walter

Application having been made by Leo Walter, the inventor named in the patent above identified, and Electronic Stamping Corp., Gardena, Calif., a corp. of Calif., the assignee, for the issuance of a certificate under the provisions of Title 35, Section 256, of the United States Code, adding the name of Helmut W. Greul as a joint inventor, and a showing and proof of facts satisfying the requirements of the said section having been submitted, it is this 27th day of October 1981, certified that the name of the said Helmut W. Greul is hereby added to the said patent as a joint inventor with the said Leo Walter.

Fred W. Sherling
*Associate Solicitor.*